United States Patent [19]

Blain

[11] Patent Number: 4,575,318

[45] Date of Patent: Mar. 11, 1986

[54] UNLOADING OF SCROLL COMPRESSORS

[75] Inventor: Edward S. Blain, Rockford, Ill.

[73] Assignee: Sundstrand Corporation, Rockford, Ill.

[21] Appl. No.: 641,214

[22] Filed: Aug. 16, 1984

[51] Int. Cl.[4] ..... F04C 2/04; F04C 15/04; F04C 18/04; F04C 29/10

[52] U.S. Cl. ..... 418/14; 418/55; 418/57

[58] Field of Search ..... 418/14, 16, 27, 55, 418/57; 417/212, 310

[56] References Cited

U.S. PATENT DOCUMENTS

| | | | |
|---|---|---|---|
| 801,182 | 10/1905 | Creux . | |
| 1,041,721 | 10/1912 | Ball . | |
| 1,223,997 | 4/1917 | May | 418/57 |
| 2,921,534 | 1/1960 | Schaller . | |
| 3,011,694 | 12/1961 | Audemar . | |
| 3,600,114 | 8/1971 | Dvorak et al. | 418/57 |
| 3,817,664 | 6/1974 | Bennett et al. | 418/55 |
| 3,884,599 | 5/1975 | Young et al. | 418/57 |
| 3,924,977 | 12/1975 | McCullough | 418/14 |
| 3,994,633 | 11/1976 | Shaffer . | |
| 4,178,143 | 12/1979 | Thelen et al. | 418/55 |
| 4,204,816 | 5/1980 | Bein . | |
| 4,300,875 | 11/1981 | Fischer et al. | 418/55 |
| 4,365,941 | 12/1982 | Tojo et al. . | |
| 4,383,805 | 5/1983 | Teegarden et al. . | |
| 4,389,171 | 6/1983 | Eber et al. . | |

FOREIGN PATENT DOCUMENTS

| | | | |
|---|---|---|---|
| 55-60684 | 5/1980 | Japan | 418/14 |

*Primary Examiner*—John J. Vrablik

*Attorney, Agent, or Firm*—Wood, Dalton, Phillips, Mason & Rowe

[57] ABSTRACT

A positive displacement compressor or pump of the scroll type including first and second scroll plates (10, 12) having convoluted interfitting vanes (16). The flanks (18) of the vanes (16) on scroll plates (14) are interfitting and in sealing contact (20) with one another and the tips (22) of the vanes (16) in sealing contact with the other plate (14). One of the plates (14) has a generally central port and the assemblage is provided with a peripheral port (39) at the interface of the plates (14). A motor (35) and linkage (38) are provided to cause the plates to undergo orbital movement relative to each other and a selectively operable mechanism (40, 44, 46, 48; 62, 66, 76) is operable to separate the plates (14) to break sealing contact and thereby unload the compressor or pump.

2 Claims, 2 Drawing Figures

UNLOADING OF SCROLL COMPRESSORS

FIELD OF THE INVENTION

This invention relates to positive displacement apparatus of the scroll type, and more particularly, to such apparatus employed as a compressor or a pump and to means for unloading the same.

BACKGROUND ART

Prior art of possible relevance includes the following U.S. Pat. Nos. 1,041,721 issued Oct. 22, 1912 to Ball; 3,600,114 issued Aug. 17, 1971 to Dvorak et al; 4,178,143 issued Dec. 11, 1979 to Thelen et al; 4,383,805 issued May 17, 1983 to Teegarden et al; and 4,389,171 issued June 21, 1983 to Eber et al. In addition, Japanese patent publication No. 53-141913 may be of relevance.

As is well known, many devices such as electric motors consume large quantities of energy when they are being started up. And, of course, the higher the loading during start-up, the more energy that is required. In some cases, where the motor is permanently coupled to the load, in order to overcome loadings during start-up, oversized motors are employed. That is, motors larger than would be required to maintain the load during constant state running conditions are necessitated in order to start-up when loaded.

In other environments, compressors or pumps may serve as auxiliary devices connected to a prime mover whose principal purpose is to provide power to perform some work other than the driving of the compressor for the pump. A primary example in an air conditioning system in an automotive vehicle.

In order to conserve energy, electically operated clutches are frequently inserted in the drive train between the prime mover and the compressor or pump so as to engage the latter to the former only where there is a requirement for the operation of the pump or compressor to save energy. This approach, while satisfactory in achieving energy savings, includes the extra expense of the clutch which in turn takes away from the desirable simplicity of the system.

The present invention is directed to overcoming one or more of the above problems in an environment where the load or pump or compressor is a scroll type positive displacement apparatus.

SUMMARY OF THE INVENTION

It is the principal object of the invention to provide a new and improved compressor or pump of the scroll type. More specifically, it is an object of the invention to provide such a compressor or pump that may be selectively unloaded during start-up to minimize energy requirements and/or prime mover size; and/or which may be utilized as an auxiliary piece of equipment to be driven by a prime mover without the need for the use of a clutch to decouple the same when its functioning is not required.

An exemplary embodiment of the invention achieves the foregoing objects in a structure including first and second scroll plates having convoluted interfitting vanes. The flanks of the vanes on one plate are in sealing contact with the flanks of the vanes on the other plate at at least two locations while the tips of the vanes on each plate are in sealing contact with the other plates so as to form at least one sealed pocket between the plates. A generally central port is disposed in at least one plate through which fluid may pass and a peripheral port is located at the interface of the plates spaced outwardly from the central port. Means are provided for causing the plates to undergo orbital movement relative to each other to cause the pocket to deliver fluid between the ports. A selectively operable means is provided for causing the plates to separate from one another to break at least one of the sealing contacts mentioned previously to form a leakage path from the pocket to the interface between the plates to thereby unload the compressor or pump.

According to the invention, the selectively operable means may be operated to unload the compressor or pump during start-up or to unload the compressor or pump while being continuously driven when its output fluid is not required in a system with which it may be associated.

According to one embodiment, the separation movement is in the radial direction. According to another embodiment, the separation movement is in the axial direction.

Where the separation movement is in the radial direction, one embodiment of the invention contemplates that one of the plates has a shaft extending therefrom oppositely of the vanes thereon and a bearing journalling the shaft. The selectively operable means includes means for shifting the bearing in a direction generally transverse to the axis of the shaft.

This embodiment further contemplates that the bearing be received in a slidable block and that the selectively operable means comprises an actuator for sliding the block.

In one embodiment, a spring may extend between the actuator and the block and it is preferable that an adjustable stop be provided that is engagable with the block for limiting sliding movement thereof in the direction opposite the direction of relative radial movement causing the separation of the plate to thereby provide regulation for the degree of sealing contact between the flanks of the vanes.

According to the embodiment where relative axial separating movement is provided, a spring may be provided for biasing one of the plates away from the other.

Further, a fluid operated piston is disposed to act in opposition to the spring and a stop is provided for limiting movement of the piston in opposition to the spring, again to control the sealing contact. In this instance, the sealing contact being controlled is that between the tips and the opposite plates.

In a highly preferred embodiment, there is included a housing and one of the plates includes a shaft extending oppositely of the vanes thereon within the housing. A piston bore is formed in the housing concentrically with the shaft and a piston is formed with a central opening receiving the shaft and is disposed in the bore. A mounting plate is located to at least partially close the bore and the spring is interposed between the mounting plate and the piston. The mounting plate further serves as a stop for the piston by being engagable therewith.

Other objects and advantages will become apparent from the following specification taken in connection with the accompanying drawings.

DESCRIPTION OF THE PREFERRED EMBODIMENT

Figure 1:
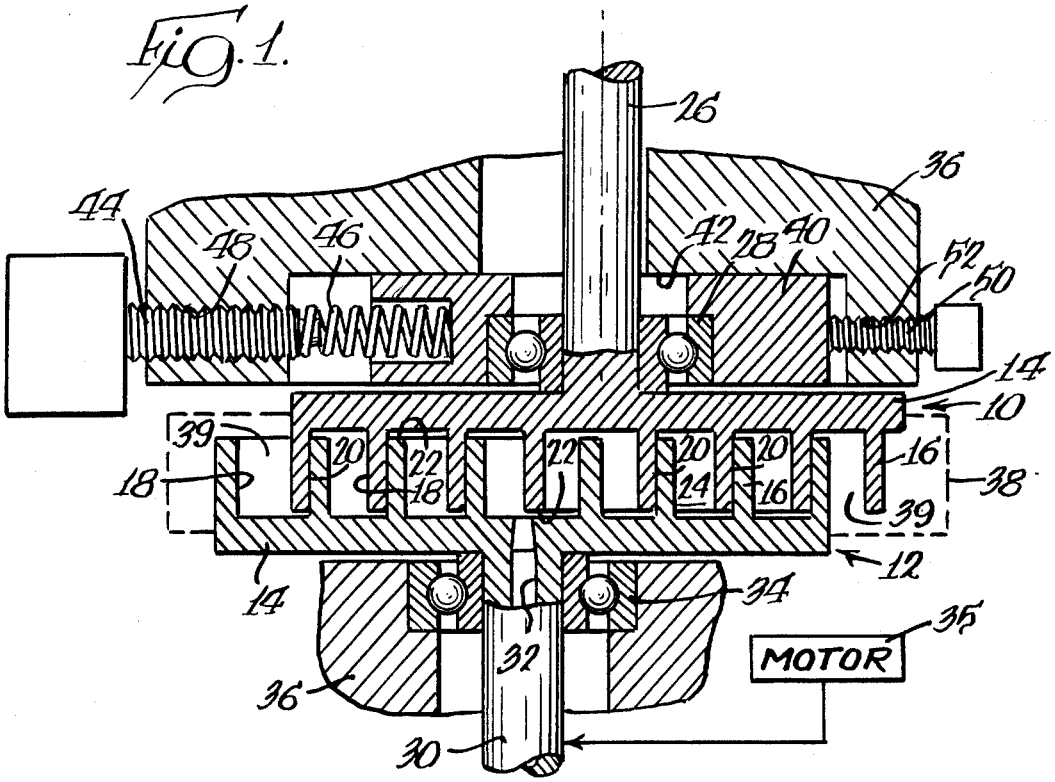
FIG. 1 is a sectional view of one embodiment of a scroll type compressor or pump made according to the invention.

An exemplary embodiment of one form of a scroll compressor or pump made according to the invention is illustrated in FIG. 1 and is seen to include first and second scrolls, generally designated 10 and 12 respectively. Each scroll 10 and 12 includes a plate-like base 14 from which one or more vanes 16 extend. The vanes 16 are generally convoluted or spiral shaped as is well known in the art and interfit with each other as illustrated in FIG. 1. The sides or flanks 18 of the vane make sealing contact with each other at two or more spaced points 20 while the tips 22 of the vanes 16 are in sufficiently close proximity to the opposite one of the plates 14 as to provide effective sealing contact therewith.

As of this consequence, one or more sealed pockets 24 exist at the interface between the scrolls 10 and 12.

The scroll 10 includes a shaft 26 extending from the plate 24 oppositely of the associated vanes 16. The shaft 26 is journalled in a bearing 28.

Similarly, the scroll 12 has a shaft 30 extending from the plate 14 oppositely of the associated vanes 16. At least one of the shafts 26 and 30, and preferably the shaft 30, is provided with an interior passage 32 which opens centrally to the interface of the scrolls 10 and 12. When the mechanism is used as a compressor or pump, the passage 32 serves as an outlet for the fluid being pumped or compressed. The shaft 30 is journalled by bearings 34 suitably mounted in a portion 36 of a housing for the assemblage.

The axis of the shaft 26 is parallel to and offset from the axis of the shaft 34 as seen in FIG. 1.

An inlet port 39 is defined by the radially outer spaced edges of the scrolls 10 and 12.

As is well known, scroll apparatus of the sort here involved fall generally into two types. In one type, the scrolls 10 and 12 do not rotate but one scroll follows an orbiting path with respect to the other. In the other type, both scrolls 10 and 12 are synchronously rotated on parallel, spaced axes which has the effect of providing relative orbiting movement between the scrolls 10 and 12. As described herein, the apparatus is of the latter type but it should be appreciated that no limitation to such type is intended since the invention is equally applicable to either.

In order to drive the scrolls 10 and 12, a motor shown schematically at 35 is suitably coupled to the shaft 30 to rotate the same. This will in turn result in rotation of the scroll 12 and to convey such motion to the scroll 10, any one of a suitable known type of couplings, such as an Oldham ring, shown schematically at 38, may be employed to couple the scrolls 10 and 12 together and yet accommodate the relative orbiting movement.

According to the embodiment illustrated in FIG. 1, unloading of the compressor or pump is achieved by forming a leakage path through the interface between the scrolls 10 and 12 from the pocket 24 to the periphery of the scrolls 10 and 12 which serve the an inlet port 39. This leakage path is established by separating the scrolls 10 and 12 in the radial direction thereby breaking the sealing contact found at 20 between the flanks 18 of the vanes 16. As illustrated in FIG. 1, the movement required will be to reduce the spacing between the rotational axes of the shafts 26 and 30. To achieve this, the bearing 28 is received in a slidable block 40 disposed in a recess 42 extending tansversely to the axis of the shaft 26. A rotary actuator in the form of a screw shaft 44 connects to the block 40 by a spring 46. By backing the rotary actuator 44 out of a threaded bore 48 in the housing 36, the block 40 will move to the left as viewed in FIG. 1 thereby moving the bearing 28 in the same direction and reducing the spacing between the axes of the shafts 26 and 30. This in turn will open up the sealing contact found between the flanks 18 to establish the aforementioned leakage path.

This operation may be performed whenever it is desired to unload the compressor or pump as, for example, during start-up or when its output is not required in a system in which it is used.

To load the pump, the screw shaft 44 is rotated in the opposite direction thereby driving the block 40 to the right to the position illustrated in FIG. 1 at which time sealing contact at points 20 between the flanks 18 of the vanes 16 will again be established.

To avoid undue contact pressure at the sealing points 20, a bolt 50 may be threaded in a bore 52 in the housing in a position to limit rightward movement of the block 40. The bolt 50 thus forms an adjustable stop.

Figure 2:
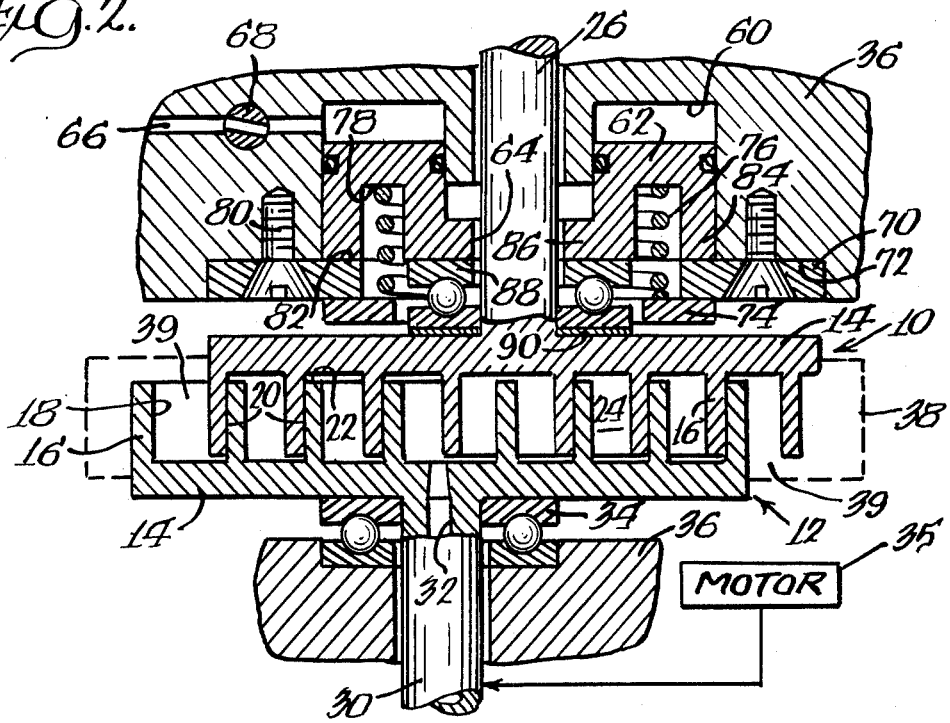
FIG. 2 is a sectional view of another embodiment of the invention.

As will be apparent from a description of the embodiment shown in FIG. 2 that follows, other forms of actuators other than a screw shaft 44 may be employed. For example, a piston could be utilized to act on the block 40 and/or a spring could be used acting in opposition to any such piston.

A second embodiment of the invention is illustrated in FIG. 2 and in the interest of brevity, like components will be given like reference numerals.

In the embodiment illustrated in FIG. 2, a leakage path from the pockets 24 to the inlet 39 along the interface between the scrolls 10 and 12 is also established. However, in this embodiment, the sealing contact 20 between the flanks 18 of the vanes 16 is not broken. Rather, the sealing contact between the tips 22 of each vane 16 and the opposite plate 14 is broken. To achieve this, the scrolls 10 ad 12 are separated in an axial direction.

An upper portion of the housing 36 is provided with an annular piston bore 60 in which an annular piston 62 is slidably received. Both the bore 60 and the piston 62 are concentric with the shaft 26 for the scroll 10 and the piston 62 is provided with a central opening 64 through which the shaft 26 may pass. A control port 66 extends to the upper end of the bore 60 via a control valve 68 which may provide a controlled bleeding of pressure from the bore 60.

An annular plate 70 is secured within a recess 72 in the housing 36 generally concentric with the bore 60 to at least partially close the same. The same includes a step 74 of annular configuration which serves to support one end of a spring 76 which also extends into an annular groove 78 in the underside of the piston 62. The plate 70 is held in place by screws 80.

By reason of this construction, the piston 62 is biased upwardly within the bore 60. Thus, the spring 76 acts in opposition to the piston 62 when the latter is pressurized via conduits 66.

It will be noted that an edge 82 of the plate extends radially inwardly of the outer periphery of the bore 60 and may be engaged by the skirt 84 of the piston 62. Thus, the edge 82 serves as a stop to limit downward movement of the piston 62 within the bore 60.

The piston is also provided with a radially inner skirt 86 to which is suitably secured a combination thrust and journal bearing 88 for the shaft 26. The bearing 88 is also suitably secured to the plate 14 of the scrolls 10 and/or the shaft 26. As a consequence of this construction, when the piston 62 is pressurized sufficiently so as to overcome the biasing force provided by the spring 76, the scroll 10 will be axially moved toward the scroll 12 until the skirt 84 of the piston 62 abuts the edge 82 of the plate 70 at which time sealing contact between the tips 22 of the vanes 16 and the opposite plate 14 will be established. Conversely, when pressure is released on the piston 62, the spring will move the piston 62 upwardly within the bore 60. This in turn will, via the skirt 86 and the bearing 88, move the scroll 10 axially away from the scroll 12 establishing the aforementioned leakage path by breaking sealing contact between the tips 22 and the plates 14.

To assure that proper sealing contact is obtained when the piston 62 is at its lowermost point in the bore 60, shims 90 may be interposed between the lower race of the bearing 88 and the plate 14 of the scroll 10.

A source of pressure to be applied to the conduit 66 may be achieved by any suitable means. For example, a pump (not shown) driven by the motor 35 may be provided. Before start-up, such pump will not be driven so there will be no pressure applied to the piston 62 and the spring 76 will act to axially separate the scrolls 10 and 12 to unload the compressor or pump defined thereby. When the motor is started, such pump will gradually provide fluid under pressure through the conduit 66 to gradually overcome the bias of the spring 76 to allow the piston 62 to urge the scroll 10 toward the scroll 12 and establish the requisite sealing contact between the tips 22 and the plates 14. Should, during operation, it be desired to unload the apparatus, pressurized fluid from the conduit 66 may be bled off to allow the spring 76 to separate the scrolls 10 and 12.

Alternatively, if the break in sealing contact between the tips 22 and the plates 14 is not so great so as to allow no pressure build-up in the pockets 24, the pump or compressor may be substantially wholly unloaded and yet providing sufficient compressed fluid, at an extremely low pressure, sufficient to overcome the resistance provided by the spring 76 if the latter is appropriately chosen.

It should also be appreciated that an actuating system such as shown in FIG. 2 is not limited to relatively axially movable scrolls 10 and 12 but could be employed to provide the desired sliding movement of the block 40 in an embodiment such as shown in FIG. 1.

From the foregoing, it will be seen that scroll type compressors or pumps made according to the invention are ideally suited for use where selective unloading of the pump or compressor is required. Where the same are driven by electric motors, by unloading the pump or compressor during start-up, a smaller motor may be utilized since power requirements for start-up are minimized through unloading of the compressor.

It will also be seen that such pumps or compressors are ideally suited for use as auxiliary apparatus to a prime mover as, for example, in automotive air conditioning systems. Rather than employing a clutch in the drive train between an automobile engine and the compressor or pump, the same may be continuously coupled thereto. When an output from the compressor or pump is not demanded by the system in which it is employed, the compressor or pump may be unloaded thereby reducing energy requirements to those required simply to overcome the friction in the bearings.

I claim:

1. A positive displacement compressor or pump of the scroll type comprising:

a bearing;

first and second scroll plates having convoluted, interfitting vanes, the flanks of the vane(s) on one plate being in sealing contact with the flanks of the vane(s) on the other plate at at least two locations, the tips of the vane(s) on each plate being in sealing contact with the other plate whereby at least one sealed pocket exists between said plates, one of said plates having a shaft extending therefrom oppositely of the vane(s) thereon and journalled in said bearing;

a slidable block receiving said bearing;

a generally central port in at least one plate through which fluid may pass;

a peripheral port to the interface of said plate spaced outwardly from said central port;

means for causing said plates to undergo orbital movement relative to each other to cause said pocket(s) to deliver fluid between said ports; and selectively operable means for causing said plates to separate from one another to break at least one of said sealing contacts and form a leakage path from said pocket(s) through the interface between said plates to thereby unload said compressor or pump, said selectively operable means including an actuator and spring means extending between said actuator and said block, said actuator being operable to slide said block to thereby shift said bearing in a direction generally transverse to the axis of said shaft to separate said plates by relative radial movement to establish said leakage path.

2. The positive displacement compressor or pump of claim 1 further including an adjustable stop engagable with said block for limiting sliding movement thereof in the direction opposite the direction of relative radial movement causing said separation of said plates.

* * * * *